United States Patent [19]

Sapronetti

[11] 4,285,087

[45] Aug. 25, 1981

[54] HAIRBRUSH SHIELD

[76] Inventor: Giuseppe Sapronetti, 12731 Victory Blvd., North Hollywood, Calif. 91606

[21] Appl. No.: 114,107

[22] Filed: Jan. 21, 1980

[51] Int. Cl.[3] ..... A46B 17/00

[52] U.S. Cl. ..... 15/159 R; 15/176; 15/248 R; 132/85; 30/295; D4/35

[58] Field of Search ..... 15/105, 111, 112, 113, 15/159 R, 186, 187, 188, 160, 176; 132/11 R, 11 A, 7, 9, 85, 120, 124; D4/29-35; 30/295

[56] References Cited

U.S. PATENT DOCUMENTS

| | | | |
|---|---|---|---|
| D. 171,556 | 2/1954 | Racicot | 15/160 X |
| D. 248,996 | 8/1978 | Brunas | D4/35 |
| 573,215 | 12/1896 | Gleim | 30/295 X |
| 734,354 | 7/1903 | Newbrd et al. | 15/187 |
| 2,167,196 | 7/1939 | Bothum | 15/111 X |
| 2,497,749 | 2/1950 | Wagner | 15/248 R |

FOREIGN PATENT DOCUMENTS

| | | | |
|---|---|---|---|
| 1925013 | 11/1970 | Fed. Rep. of Germany | 15/111 |
| 1476415 | 2/1967 | France | 15/160 |

*Primary Examiner*—Peter Feldman
*Attorney, Agent, or Firm*—Roger A. Marrs

[57] ABSTRACT

A hairbrush is disclosed herein having an elongated handle with a body forwardly disposed thereof for carrying a plurality of bristles in a downwardly depending fashion. Outwardly projecting from opposite sides of the body, there is provided a contoured shield having an upwardly sweep developed from a fore-and-aft trough and terminating in an edge which diverges upwardly and outwardly from the forward end of the brush rearwardly towards the handle thereof. The shield further includes a skirt integrally formed with a forward portion of the shield just described which is downwardly flared to terminate in an arcuate trailing edge. The upper terminating edges of the skirt are outwardly flared in a reverse curve. A plurality of ribs are integrally formed at the intersection of the shield forward portion and the skirt portion which serve as heat sinks for the shield. A finger knob is carried on the body adjacent the area of contact with the handle for grasping by the thumb and first finger of the users hand. The shield may be integrally formed with the body of the brush or may be snapped thereon in a releasable fashion.

7 Claims, 8 Drawing Figures

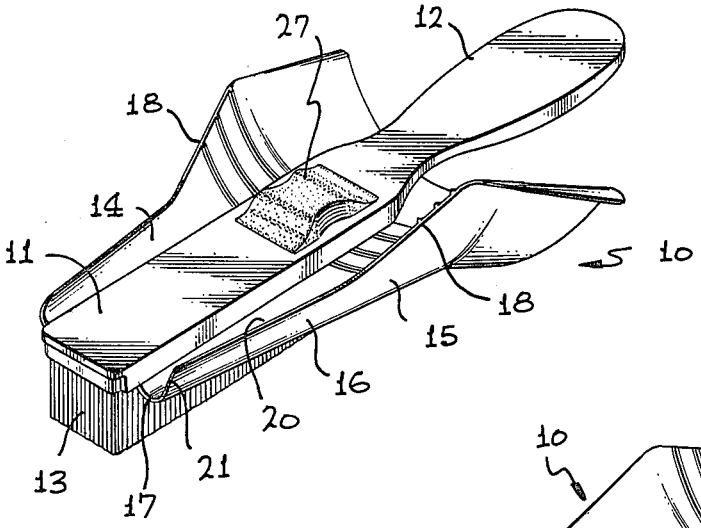
FIG. 1
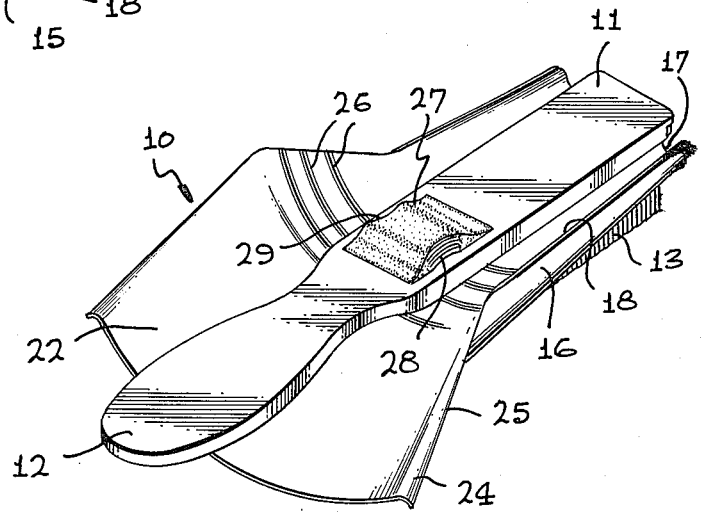
FIG. 2
FIG. 3
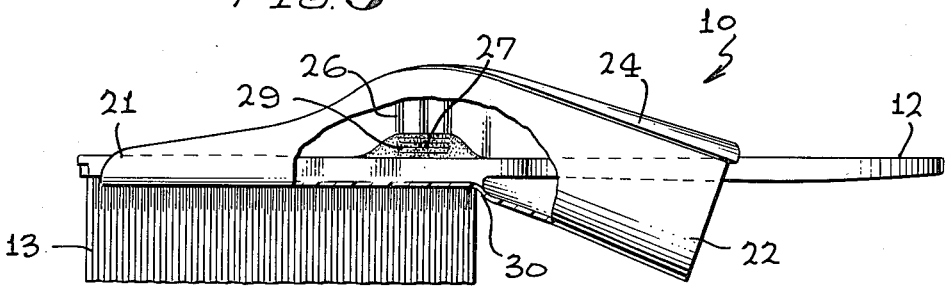
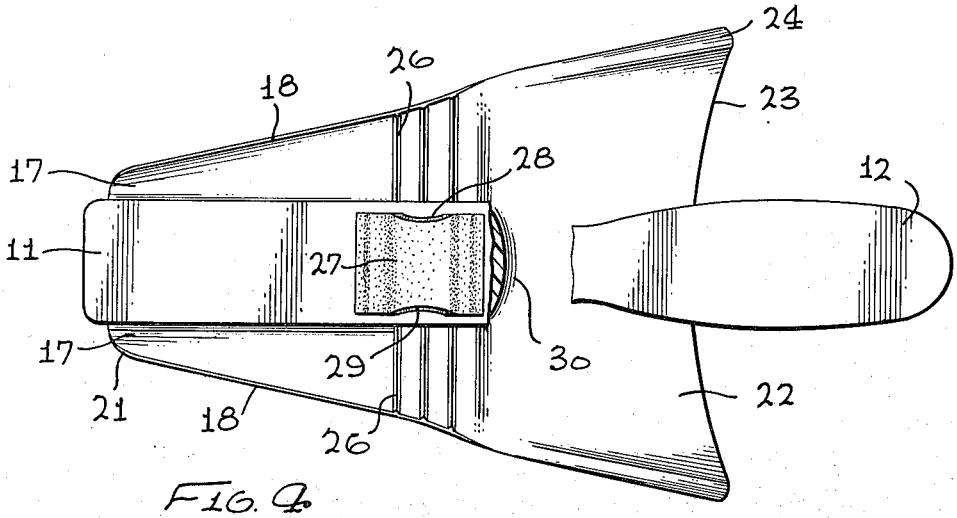
FIG. 4

HAIRBRUSH SHIELD

BACKGROUND OF THE INVENTION

1. Field of the Invention

The present invention relates to hairbrushes and more particularly to a novel hairbrush having a shield for protecting the hand of the user against the adverse affects of heat generated from a hair blower and for assisting in styling and contouring of the hair.

2. Brief Description of the Prior Art

In the past, it has been the conventional practice of a hairdresser to carry a brush in one hand and a blower in the other hand. The brush and blower are used in unison by the hairdresser for styling and contouring the hair of the client. During this procedure, the heated air often irritates or burns the skin of the hairdressers hand holding the brush which is obviously uncomfortable and greatly restricts the hairstyling procedure. Also, only the bristles of the brush come into contact with the hair so that the hairdresser is deprived of other implements which could be useful in hairstyling. In the event that the hairdresser desires to use another implement, he must then place the hairbrush on a table and pick up the desired implement so that it may be introduced to the styling procedure.

Also, with regard to the blast of air from the blower, it is understood that the temperature of the air from the blower is quite elevated and that once the stream of air has passed the head of the client or customer, the heated air is no longer useful and is detrimental not only to the hand of the hairdresser bearing the brush but to his arm, face and other portions of the body or clothing which are close by.

Therefore, a long standing need has existed to provide a means for deflecting the hot air blast issuing from a blower so that the hot air is not directed against the hand, arm or other portions of the hairdressers body or clothing. Also, a need has existed to provide various shapes of implements on the hairbrush itself which the hairdresser may employ during a styling procedure to gain a particular style or effect of hairdressing.

SUMMARY OF THE INVENTION

Accordingly, the above problems and difficulties are obviated by the present invention which provides a novel hairbrush having an elongated body terminating in a handle at the rear end thereof. The body further includes a shield or hot air deflector outwardly projecting from the opposite sides of the body wherein the shield includes a forward portion which is contoured in a general upward sweep developed from a fore-and-aft trough so as to terminate in a rearwardly diverging edge. At the rear of the front portion of the shield, a skirt is provided which incorporates a downward flare to terminate in an arcuate trailing edge. The diverging side edges of the front portion are co-extensive with opposite skirt edges that form a reverse flare from the arcuate contour.

Midway between the opposite ends of the shield or deflector, there is provided a heat sink means comprising a plurality of intregally formed stiffening ribs which radiate laterally outwardly from opposite sides of the body and which are carried on the front portion of the shield. Located on top of the body between the heat sink means on each of the shield or deflector means, there is provided a finger gripping knob or member which includes side contours adapted to be grasped by the first finger and thumb of the user. The under side of the body portion includes a downwardly extending projection which joins with the front portion and the skirt which terminates at the end of the plurality of bristles.

Therefore, it is among the primary objects of the present invention to provide a novel hair brush having a hot air deflector or shield for redirecting a stream of hot air away from the hand of the hairbrush user.

Another object of the present invention is to provide a novel hairbrush having a shield or deflector means for redirecting a hot air stream from a blower away from the users hand and which incorporates heat sink means so as to maintain the temperature of the shield or deflector means at a tolerable level.

Still another object of the present invention is to provide a novel shield or heat deflector means adapted to be carried on the body of a brush and which is specifically contoured to direct a hot air stream from a blower away from the brush when in use and wherein the contours are readily available for contouring a persons hair during the brushing procedure.

Yet another object of the present invention is to provide a novel shield or deflector means which may be readily carried on a hairbrush or protecting the hairdressers hand from the heated stream issuing or discharging from a blower and which may be readily used for contouring a customers hair during the brushing procedure.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in conjunction with the accompanying drawings in which:

FIG. 1 is a front perspective view of the novel shield or deflector means of the present invention shown intregally formed with a hair brush;

FIG. 2 is a rear perspective view of the shield or deflector means shown in FIG. 1;

FIG. 3 is a side elevational view of the shield and deflector means shown in FIGS. 1 and 2 and having a portion broken away to expose the central construction thereof;

FIG. 4 is a top plan view of the shield and deflector means of the present invention;

DESCRIPTION OF PREFERRED EMBODIMENTS

Figure 5:
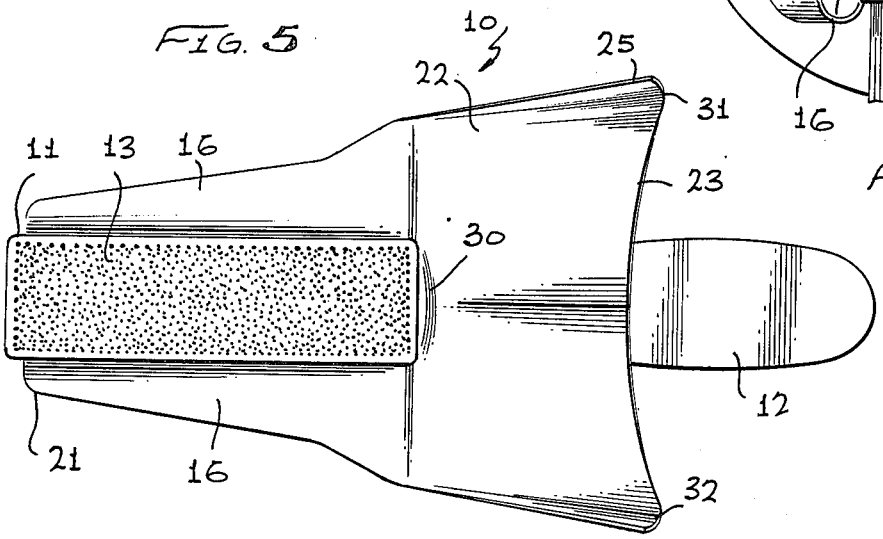
FIG. 5 is a bottom plan view of the shield or deflector means.

Referring to FIG. 1, the novel hairbrush incorporating the shield or deflector means is shown in the general direction of arrow 10. The brush includes a main body 11 having a handle portion 12 and a plurality or brishtles 13 downwardly depending from the body 11. The shield or deflector means includes a pair of shield portions 14 and 15 which are carried on opposite sides of the body 11 of the hairbrush. Each of the shield portions includes a front portion indicated in general by numeral 16 which are configured in an upward curve from a trough 17 located immediately adjacent the attachment with the body 11. The upward configuration or curvature of the front portion of the shield terminates in a diverging edge 18 leading from the front of the brush rearwardly. The diverging edges 18 are coextensive with a forward sloping edge 20 which terminates in a rounded nose 21 forming the front of the trough 17.

Referring now in detail to FIG. 2, it can be seen that the front portion 16 of the shield terminates in a skirt identified by numeral 22 which downwardly slopes and terminates in an arcuate trailing edge 23. The skirt is intregally formed with the front portion 16 of each of the shield portions.

The opposite lateral sides of the skirt 22 are provided with a folded over portion 24 which forms a reverse curve to the arcuate edge 23 and terminates in a downward edge 25 coextensive with the edge 18. At the rear of each of the front portions 16, and formed intregally therewith on the inside curve thereof, there is provided a heat sink means taking the form of a plurality of ribs, such as rib 26. The ribs are intended to collect heat from the skirt and front portion so that the users fingers will not become heated. Also, it can be seen that a knob or finger member 27 is centrally located on the body 11 between the pair of shield portions. The opposite sides of the knob or member 27 are contoured so as to comfortably receive the first finger and thumb of the user when the handle 12 is grasped in his hand.

Referring now to FIG. 3, it can be seen that the knob or member 27 is located adjacent the heat sink means on each of the shielf portions and that, as shown in FIG. 4, the lateral indentations thereon are identified by numerals 28 and 29 respectively.

It can also be seen in FIGS. 3 and 4 that the underside of the brush includes a downwardly depending and sloping member 30f which is at the end of the plurality of bristles 13 and which is located immediate the juncture of the shield front portion and the skirt 22.

Figure 6:
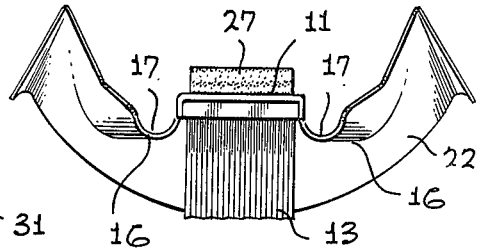
FIG. 6 is a front elevational view of the shield or deflector means.

Referring now in detail to FIG. 5, it can be seen that the shield is an intregal formed construction so that the unitary structure is provided with the brush and wherein the skirt 22 is formed with the shield front portions 16 associated with each side of the body 11. It can also be seen that the trailing edge 23 is not only arcuate in front elevation, as shown in FIG. 6, but is arcuate in plan view between the rounded corners 31 and 32 terminating the folded over edges 25.

In as much as a unitary structure or construction is provided in the hairbrush and shield or deflector means design shown in FIGS. 1–7 inclusive, the numbers applied thereto are not repeated on the opposite side of the body and handle.

Figure 7:
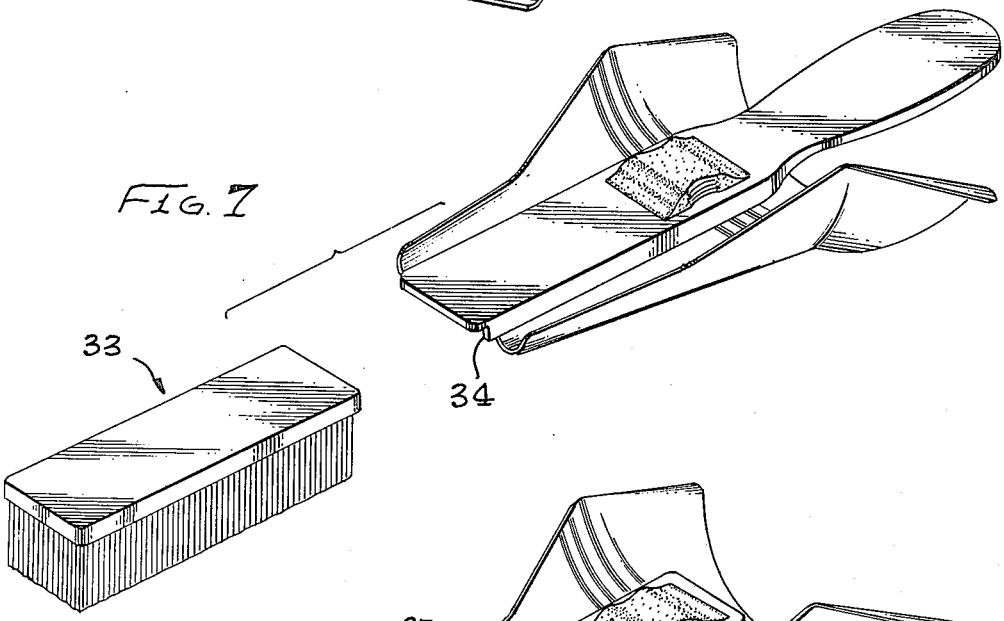
FIG. 7 is an exploded perspective view showing the handle and shield and deflector means formed as an integral member adapted to insertably receive a brush member.

Referring now in detail to FIG. 7, another embodiment of the present invention is shown wherein the shield or deflector means is attached to a handle and body which is detachably connected to a brush or bristle assembly identified in the general direction of arrow 33. The above construction is identical in terms of the shield or deflector means and identical numbers are employed in the embodiment of FIG. 7. The only exception resides in the fact that the body 11 is provided with a track 34 on the underside thereof adapted to slidably receive the brush assembly 33.

Figure 8:
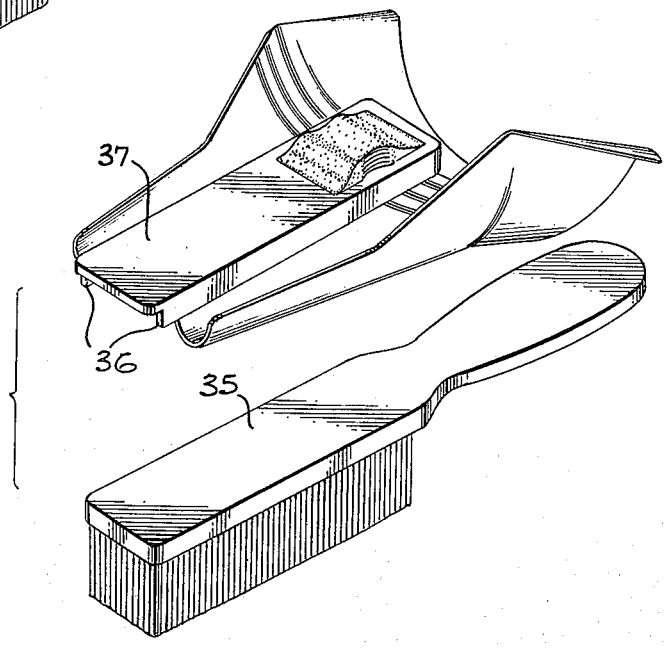
FIG. 8 is a front perspective exploded view showing the shield and deflector means as an attachment to a conventional brush construction.

Another version of the invention is illustrated in FIG. 8 wherein the shielf or deflector means is a separate attachment for a conventional brush illustrated by numeral 35. The body of the brush 35 is adapted to receive a channel 36 formed on the underside of a body portion 37 separating the portions of the shield or deflector means. As previously described, the identical reference numerals are applied to the figure since the contour, shape and configuration of the shield or deflector is identical to that shown in FIGS. 1–7 inclusive.

Therefore, it can be seen from the foregoing that the novel hairbrush invention of the present invention provides a novel means for protecting a hairdressers hand from the adverse affects of a hot air stream issuing or discharged from a blower. Also, the hairdresser may utilize the special contour of the shield for contouring the hair of a client or customer during the hairbrushing procedure. The user grasps the brush by the handle 12 and grips the member or knob 27 between the thumb and first finger of the hand. The hot air blast from the blower strikes the underside of the shield or deflector means and diverts a stream of air upwardly and to the side away from the hand and arm of the user.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A hairbrush shield comprising:
an elongated hairbrush having a handle at one end and body at the other end incorporating downwardly depending bristles; and
a contained shield outwardly projecting from opposite sides of said body and having a fore-and-aft trough provided immediately adjacent each side of said body so as to develop an upwardly sweep terminating in an outer edge which diverges upwardly and outwardly from the forward end of said hairbrush rearwardly towards said handle.

2. The invention as defined in claim 1 including:
a skirt integrally formed with said shield downwardly flared substantially under said handle to terminate in an arcuate trailing edge joining said outer edges of each side of said shield.

3. The invention as defined in claim 2 wherein:
said skirt includes upper terminating edges co-extensive with said shield outer edges which are outwardly flared in a reverse curve.

4. The invention as defined in claim 3 including:
a plurality of ribs integrally formed on said shield at the intersection of said shield with said skirt so as to function as a heat sink means therefor.

5. The invention as defined in claim 4 wherein:
said shield and skirt are detachably carried on said hairbrush.

6. The invention as defined in claim 4 including:
a finger knob carried on said hairbrush mid-way between its opposite ends adjacent the junction of said body and said handle for grasping by the thumb and first finger of the users hand.

7. The invention as defined in claim 6 wherein:
said skirt curvature defines a substantial cavity beneath said handle to accommodate the users fingers about said handle.

* * * * *